US006810806B2

(12) United States Patent
Faulhammer et al.

(10) Patent No.: US 6,810,806 B2
(45) Date of Patent: Nov. 2, 2004

(54) PRINTING MACHINE WITH COMPENSATION ELEMENTS FOR COMPENSATING SPEED DIFFERENCES AND TRANSFER ERRORS BETWEEN PRINTING GROUPS AND METHOD OF TRANSFERRING PRINTED SHEETS IN SUCH A PRINTING MACHINE

(75) Inventors: Holger Faulhammer, Stuttgart (DE); Bernhard Wagensommer, Gaiberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 94 days.

(21) Appl. No.: 09/771,450

(22) Filed: Jan. 26, 2001

(65) Prior Publication Data

US 2001/0013292 A1 Aug. 16, 2001

(30) Foreign Application Priority Data

Jan. 26, 2000 (DE) ..... 100 03 141

(51) Int. Cl.[7] ..... B41F 21/10
(52) U.S. Cl. ..... 101/410; 101/246
(58) Field of Search ..... 101/248, 246, 101/410, 484, 232, 409; 400/208.1, 208, 207, 225, 234, 242, 244, 247

(56) References Cited

U.S. PATENT DOCUMENTS

| | | | | | |
|---|---|---|---|---|---|
| 4,458,893 | A | * | 7/1984 | Ruh | 101/248 |
| 4,702,469 | A | * | 10/1987 | Jeschke et al. | 271/227 |
| 5,040,460 | A | * | 8/1991 | Stark et al. | 101/232 |
| 5,333,547 | A | * | 8/1994 | Pfisterer et al. | 101/232 |
| 5,383,392 | A | * | 1/1995 | Kowalewski et al. | 101/183 |
| 5,390,601 | A | * | 2/1995 | Fricke et al. | 101/409 |
| 5,481,971 | A | * | 1/1996 | Grutzmacher et al. | 101/183 |
| 5,596,929 | A | * | 1/1997 | Fricke et al. | 101/232 |
| 5,862,757 | A | * | 1/1999 | Hauck | 101/484 |

FOREIGN PATENT DOCUMENTS

| | | |
|---|---|---|
| DE | 44 06 740 A1 | 9/1995 |
| DE | 19742 461 A1 | 4/1999 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A printing machine, which includes at least two printing unit groups having drives which are decoupled from one another and assigned, respectively, to one printing unit group, and having printing units with transfer cylinders, include compensation elements for compensating for speed differences and positional errors between two printing unit groups. The compensation elements are assigned to a printing unit group which is an accepting printing unit group, in order to compensate for transfer errors.

11 Claims, 3 Drawing Sheets

PRINTING MACHINE WITH COMPENSATION ELEMENTS FOR COMPENSATING SPEED DIFFERENCES AND TRANSFER ERRORS BETWEEN PRINTING GROUPS AND METHOD OF TRANSFERRING PRINTED SHEETS IN SUCH A PRINTING MACHINE

BACKGROUND OF THE INVENTION

Field of the Invention

The invention relates to a printing machine, preferably for printing sheet-type material, which includes at least two printing unit groups having drives which are decoupled from one another and assigned, respectively, to one printing unit group, the printing unit groups having printing units with transfer cylinders and, for transferring the printed sheets, a dynamic control device and compensation elements for compensating for speed differences and positional errors between two printing unit groups. In addition, the invention relates to a method of transferring printed sheets in a printing machine of this type.

A printing machine with a great number of printing units is beset by a problem that the fundamental or inherent mechanical frequency thereof shifts to ever lower values the greater the number of printing units. This fundamental frequency is already excited at the printing speeds which are common nowadays, and contributes to an impairment or deterioration of the printed image.

Approaches for minimizing the influence of these fundamental or inherent frequencies are, for example, active or passive oscillation damping. With regard to active oscillation damping, the oscillations are damped by employing highly dynamic actuators for introducing additional energy for damping, while passive dampers, such as absorber systems, serve merely for absorbing the oscillation energy.

An alternative to these systems is offered by printing machines which are decoupled into two or more printing unit groups, each printing unit group containing its own drive. In this regard, during the transfer of a printed sheet from a preceding printing unit group to a succeeding printing unit group, differences in the speed and the position of the transported printing sheets have to be taken into account. These differences produce a transfer error leading to damage to the printed sheet or to faulty printing results.

In order to reduce this transfer error, the published German Patent Document DE 197 42 461 A1 discloses a device and a method for synchronizing printing unit groups. For this purpose, the device is provided with a transfer station having a separate drive. The separate drive is initially synchronized with the operating parameters of the preceding printing unit group, and the printed sheet is accepted by the transfer station. The drive of the transfer station is then synchronized with the succeeding printing unit group, and the printed sheet is passed on to the latter. A disadvantage of this device is that a transfer station is required for each printing unit group. In addition to a control system, a considerable amount of mechanical equipment is required for realizing this synchronization. In addition, torque fluctuations which are caused by the transfer devices, such as gripper systems, remain unconsidered.

A further possibility for reducing the transfer error is disclosed by the published German Patent Document DE 44 06 740 A1. A device is described therein which has displaceably arranged sheet holders. The sheet holders are movable in the peripheral direction and in the axial direction of the transfer cylinder of the preceding printing unit group. Before the transfer, the speed difference and the positional difference of the printed sheet are determined by computation. This is performed by sensors and a control device for processing the operating parameters. If a speed difference and a positional difference, respectively, are determined, the appropriate sheet holder is displaced by actuators in the conveying direction of the printed sheet and, transversely thereto, into the calculated or computed position and is transferred to the succeeding printing unit group. The actuators are accordingly controlled by the control device.

A disadvantage of this device is that a positional displacement caused by the transfer remains unconsidered by the positional correction. It is also disadvantageous that torque fluctuations caused by transfer equipment, and a speed change induced thereby, such as are produced by gripper systems and dynamic sheet holders, remain unconsidered by the positional correction.

The transfer performed by the devices and methods of the prior art is therefore inadequate and faulty, which results in a lower print quality, and damage to the sheet material.

SUMMARY OF THE INVENTION

Consequently, it is an object of the invention to provide a method and device for compensating for transfer errors in a printing machine which overcome the foregoing disadvantages and permit error-compensated transfer of the printed sheets, with regard to position and speed, between printing unit groups.

With the foregoing and other objects in view, there is provided, in accordance with one aspect of the invention, a printing machine, which includes at least two printing unit groups having drives which are decoupled from one another and assigned, respectively, to one printing unit group, and having printing units with transfer cylinders, comprising compensation elements for compensating for speed differences and positional errors between two printing unit groups, the compensation elements being assigned to a printing unit group which is an accepting printing unit group, in order to compensate for transfer errors.

In accordance with another aspect of the invention, there is provided a printing machine, which includes at least two printing unit groups having drives which are decoupled from one another and assigned, respectively, to one printing unit group, and having printing units with transfer cylinders, comprising compensation elements for compensating for speed differences and positional errors between two printing unit groups, the compensation elements being assigned to a first transfer cylinder of a printing unit group which is an accepting printing unit group, in order to compensate for transfer errors.

In accordance with a further aspect of the invention, there is provided a printing machine for printing sheet material, which includes at least two printing unit groups having drives which are decoupled from one another and assigned, respectively, to one printing unit group, and having printing units with transfer cylinders, comprising, for transferring the printed sheets, a dynamic control device and compensation elements for compensating for speed differences and positional errors between two printing unit groups, the compensation elements being assigned to a first transfer cylinder of a printing unit group which is an accepting printing unit group, in order to compensate for transfer errors.

In accordance with an added aspect of the invention, there is provided a printing machine for printing sheet-type material, which includes at least two printing unit groups having drives which are decoupled from one another and assigned, respectively, to one printing unit group, and having printing units with transfer cylinders, which comprise, for transferring the printed sheets, a dynamic control device and compensation elements for compensating for speed differences and positional errors between two printing unit groups, the compensation elements being assigned to a printing unit group which is an accepting printing unit group, in order to compensate for transfer errors.

In accordance with an additional feature of the invention, the dynamic control device is connected for communicating with the printing unit groups so as to record operating parameters, and is connected for communicating with the compensation elements so as to control the transfer.

In accordance with yet another feature of the invention, the printing machine includes sensors selected from the group consisting at least of charge-coupled switching elements, photosensors, electronic and electromagnetic sensors, and assigned to the printing unit groups, for recording operating parameters of the printing unit groups, and for passing the parameters on to data processing elements of the dynamic control device.

In accordance with yet a further feature of the invention, the printing machine is provided with sensors selected from the group thereof consisting of charge-coupled switching elements, photosensors, and electronic and electromagnetic sensors.

In accordance with yet an added feature of the invention, the compensation elements have a gripper system which, in order to compensate for a speed difference between two printing unit groups and to correct the position of the printed sheet, is arranged parallel to the cylinder surface and axially displaceably on the first transfer cylinder of the accepting printing unit group.

In accordance with yet an additional feature of the invention, the gripper system comprises a dynamic actuator and a gripper bar for picking up the printed sheets, the position of the gripper bar being displaced by the actuator at constant radius in a peripheral direction on the transfer cylinder in accordance with the difference in speed.

In accordance with still another feature of the invention, the actuator is an element selected from the group thereof consisting of piezoelectric and magnetostrictive elements.

In accordance with still a further feature of the invention, the cylinders of the printing unit groups have an arrangement by which, after the printed sheet has been accepted by the gripper system of the transfer cylinder, the printed sheet is fixed only at one location in the accepting printing unit group.

In accordance with still an added feature of the invention, the gripper bar is axially displaceable in the direction of the axis of rotation of the first transfer cylinder for correcting the position of the printed sheet.

In accordance with still an additional feature of the invention, there is provided a method of transferring printed sheets in a printing machine, which comprises determining a difference in speed between two decoupled printing unit groups, and displacing a gripper system parallel to the surface of a cylinder during the sheet transfer so as to compensate thereby for the difference in speed between the printing unit groups on a first transfer cylinder of an accepting printing unit group.

In accordance with another aspect of the invention, the method includes determining a positional error of the printed sheet on the first transfer cylinder of the accepting printing unit group, and correcting the position of the printed sheet parallel to the cylinder surface and axially displaceably on the first transfer cylinder of the accepting printing unit group.

In accordance with a further aspect of the invention, a dynamic ce registers the operating parameters of the printing unit groups before the printed sheet is transferred, determine differences in speed and controls the compensation elements in a compensatory manner during the sheet transfer.

In accordance with an added aspect of the invention, the method includes having the dynamic control device register the position of the printed sheet on the first transfer cylinder of the accepting printing unit group after the sheet transfer, and control the compensation elements in a corrective manner after the sheet transfer.

In accordance with an additional aspect of the invention, the method includes completing the positional correction before the sheet transfer to the second cylinder of the accepting printing unit group.

In accordance with an 18. The method according to claim 13, which includes, in a first step, wherein a difference in speed is compensated for, displacing the actuator parallel to the cylinder surface of the first transfer cylinder of the accepting printing unit group; in a second step, having the gripper system of the first transfer cylinder of the accepting printing unit group accept the printed sheet from the preceding printing unit group; in a third step, registering the position of the printed sheet and, if necessary, determining a positional correction; in a fourth step, having the actuator make the positional correction on the first transfer cylinder of the accepting printing unit group; in a fifth step, having the actuator moved into a rest position for the printed sheet transfer to the second cylinder of the accepting printing unit group; and in a sixth step, moving the actuator back into the initial position thereof after the printed sheet transfer to the second cylinder of the accepting printing unit group.

The printing machine according to the invention provides one solution to the problem, compensation elements assigned to the accepting printing unit group, preferably to the first transfer cylinder of the accepting printing unit group. This makes it possible for the speed difference to be compensated for only after the transfer has already been made. The effect of this is that the torque fluctuations which, for example, are caused by a dynamic gripper system, are taken into account with the compensation of the speed difference. In addition, the positional correction takes place after the transfer, by which displacements which are made during the transfer can still be corrected. The compensation of the transfer error can therefore be carried out directly, so that it is possible to dispense with a prior calculation, which is generally erroneous, of a transfer error which is to be expected by the data processing elements of a control device.

One configuration of the invention is provided by having the dynamic control device connected so as to communicate with the printing unit groups, preferably with the individual printing units, in order to record operating parameters, and being connected so as to communicate with the compensation elements in order to control the transfer. The direct compensation for the transfer error makes it possible to take into account the operating parameters of the printing unit groups during the transfer. This makes it necessary to make the operating parameters of the control device available without delay. Advantageously, differences in the speed and the position can be detected immediately, and the compensation elements can be activated accordingly.

A further configuration of the invention is provided by sensors, preferably charge-coupled switching element, photosensors, electronic or electromagnetic sensors, being assigned to the printing unit groups, recording the operating parameters of the printing unit groups and passing the parameters on to data processing elements of the dynamic control device. Using the sensors, it is advantageously possible to register the rotational speeds of the cylinders, the conveying speed of the printed sheet and the position of the printed sheet using the edge position. In this regard, the edge position of the printed sheet is advantageously determined by using the leading edge in relation to the conveying direction of the printed sheet, because this is registered first by the sensors of the accepting printing unit group. The operating parameters of the successive printing unit groups are preferably determined. If this information is not sufficient to compensate for the transfer error, further information is registered by additional sensors, such as linear CCDs, light barriers in connection with counters and the like. Using this information, a speed difference during the transfer, and therefore the error in the transfer register can be determined. During the determination of the value for the transfer register, the action which is necessary in order to compensate for the speed difference is likewise taken into account.

In a preferred configuration of the apparatus, the compensation elements have a gripper system which, in order to compensate for a speed difference between two printing unit groups and to correct the position of the printed sheet, is arranged parallel to the cylinder surface and axially displaceably on the first transfer cylinder of the accepting printing unit group. These compensation elements can advantageously comprise a dynamic actuator, for example a piezoelectric or magnetostrictive element or a linear direct drive, and a gripper bar for picking up the sheets, the actuator displacing the position of the gripper bar at constant radius in the peripheral direction of the transfer cylinder.

According to the invention, the difference in speed is compensated for during the transfer, and the positional difference is advantageously corrected after the transfer, when the printed sheet is fixed only by a pair of cylinders in the accepting printing unit group, because then the final positional displacement can be determined. If necessary, this can be carried out directly in the printed image. To this end, according to the invention, the device has an arrangement of the cylinders of the printing unit groups by which, after the transfer of the printed sheet by the gripper system of the transfer cylinder, the printed sheet is fixed only at one location in the accepting printing unit group.

Advantageously, in order to correct the position of the printed sheet, the gripper bar can also be configured to be displaceable axially in the direction of the axis of rotation of the first transfer cylinder, in order to permit the positional correction.

A further advantageous solution is provided by a method of transferring printed sheets in a printing machine.

In this regard, a difference in speed determined between two decoupled printing unit groups is compensated for during the transfer, the gripper system on the first transfer cylinder of the accepting printing unit group being displaced parallel to the cylinder surface. A positional error of the printed sheet is corrected on the first transfer cylinder of the accepting printing unit group by the gripper system, by the latter being displaced parallel to the cylinder surface and axially in the direction of the cylinder axis.

One method variant is provided by the dynamic control device registering the operating parameters of the printing unit groups, preferably by sensors, before the transfer of the printed sheet, determining speed differences and controlling the compensation elements in a compensatory manner during the transfer. Likewise, the position of the printed sheet is registered on the first transfer cylinder of the accepting printing unit group after the transfer, and the compensation elements are controlled in a corrective manner after the transfer.

The positional correction is advantageously completed before the transfer to the second cylinder of the accepting printing unit group, because after the transfer to the second cylinder, the printed sheet is fixed at two points and a positional correction requires considerably more effort.

In a preferred configuration of the method, the steps are combined, so that in a first step, to compensate for a difference in speed, the actuator is displaced parallel to the cylinder surface of the first transfer cylinder of the accepting printing unit group, in a second step the gripper system of the first transfer cylinder of the accepting printing unit group accepts the printed sheet from the preceding printing unit group, in a third step the position of the printed sheet is registered and, if necessary, a positional correction is determined, in a fourth step the actuator makes the positional correction on the first transfer cylinder of the accepting printing unit group, in a fifth step the actuator is moved into a rest position for the transfer to the second cylinder of the accepting printing unit group, and in a sixth step the actuator is moved back into its initial position after the transfer of the printed sheet to the second cylinder of the accepting printing unit group. The actuator is positioned in its initial position, in which it can carry out the maximum compensatory movement in any direction during the next transfer. During the transfer to the second cylinder of the accepting printing unit group, the actuator is at rest in order that any positional displacement after the positional correction is avoided.

By decoupling the printing machine into a number of printing unit groups, according to the invention, and error compensation during the transfer of the printed sheet from one printing unit group to the next, very long printing machines can be realized. As a result of the configuration according to the invention, and as a result of the method, the length of the printing machine is no longer limited by mechanical influences, but only by the increase in control outlay involved in the error compensation of a number of decoupled and separately controlled printing unit groups.

Other features which are considered as characteristic for the invention are set forth in the appended claims.

Although the invention is illustrated and described herein as embodied in a device and method for transfer error compensation in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
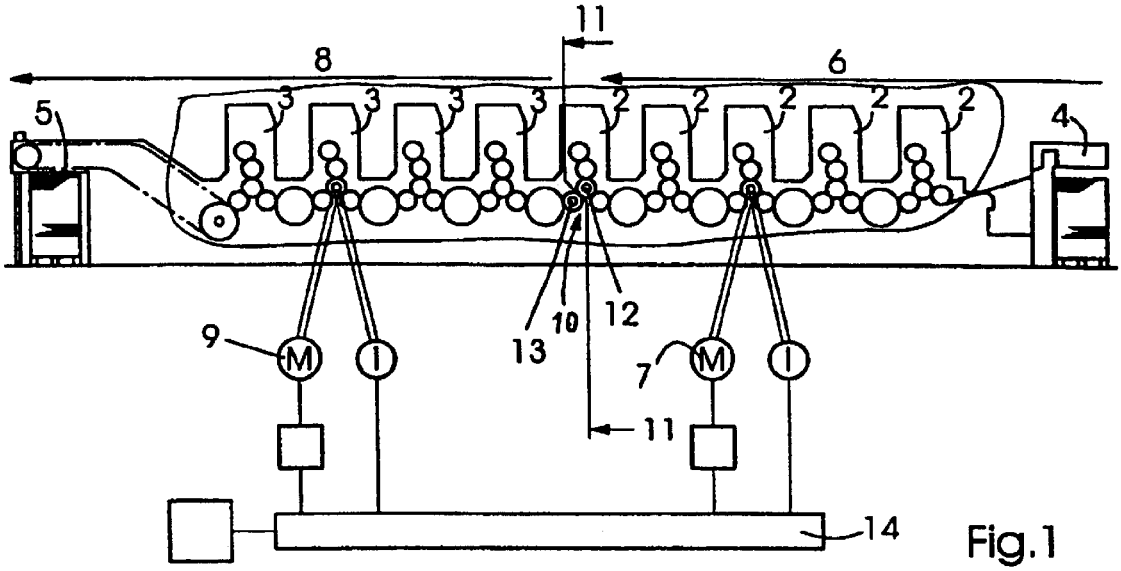
FIG. 1 is a diagrammatic side elevational view of a printing machine having a plurality of printing units, namely, nine in the illustrated embodiment, arranged in-line, and decoupled into two printing unit groups.

Referring now to the drawings and, first, particularly to FIG. 1 thereof, there is shown therein a printing machine 1 having a plurality of printing units 2 and 3, namely, nine printing units 2 and 3 in the embodiment of FIG. 1, arranged in-line. A sheet to be printed is transported from a feeder 4, through the printing units 2 and 3, to a delivery 5. The printing units 2, which constitute a printing unit group II, and the feeder 4 are connected to one another by a gear train, which is represented by an arrow 6. The drive to this printing unit group II, together with the feeder 4 is effected by a motor 7. The printing units 3, which constitute a printing unit group III, together with the delivery 5 are likewise connected to one another by a gear train, which is represented by an arrow 8. The drive for this printing unit group III together with the delivery 5 is provided by a motor 9. Between the two printing unit groups II and III, respectively, the printed sheet is transferred from the printing unit group II to the printing unit group III by transfer elements 10. Arrows 11 indicate a transfer plane between the printing unit groups II and III. The transfer elements 10 in the illustrated embodiment of FIG. 1 are represented by an impression cylinder 12 and a transfer cylinder 13. The plane represented by the line 11 also represents the decoupling of the printing unit groups II and III, the impression cylinder 12 of the printing unit group II being assigned to the transfer cylinder 13 of the printing unit group III. The printed sheet is passed on from the impression cylinder 12 to the transfer cylinder 13. The transfer error compensation is performed at the transfer cylinder 13.

For this purpose, the motors 7 and 9 are controlled by a control device 14. The task of the control device 14 is to control the motors 7 and 9 in accordance with a prescribed desired or nominal speed so that the prescribed angular difference between the two printing unit groups II and III is not exceeded. The maximum difference depends upon the dynamics of the drives. In addition, the task of the control device 14 is to determine the operating parameters at the instant of time that the printed sheet transfer occurs and to communicate the parameters to the compensation elements 15. The compensation elements 15 are not shown as such in FIG. 1 and are assigned to a gripper system 18 on the transfer cylinder 13. According to the invention, the compensation elements 15 serve to compensate for the transfer error.

Figure 2:
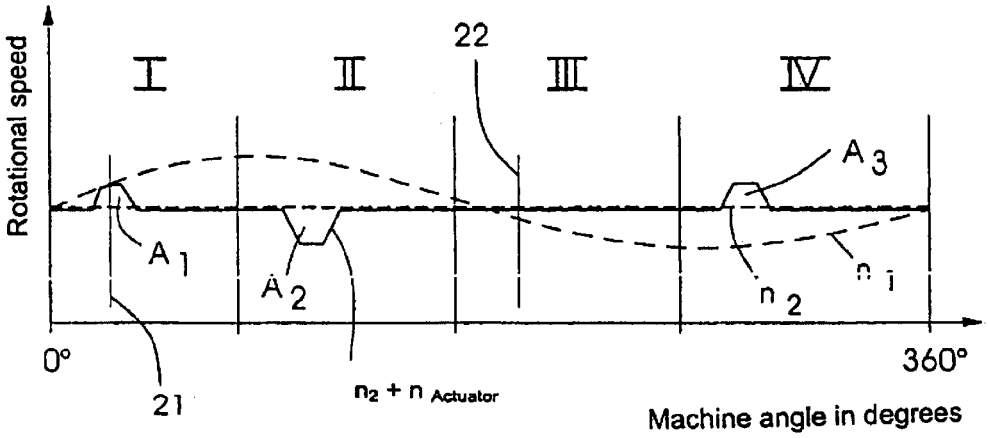
FIG. 2 is a plot diagram or coordinate representation of the rotational speeds of the printing unit groups plotted against the machine angle in degrees during the transfer of a printed sheet.

FIG. 2 is a coordinate representation or plot diagram of the rotational speeds of the printing unit groups II and III against the machine angle in degrees. The curve $n_1$ represents the rotational speeds of the printing unit group II from FIG. 1; the curve $n_2$ represents the rotational speeds of the printing unit group III from FIG. 1. The rotational speeds $n_1$ of the printing unit group II, fluctuate with respect to the rotational speeds $n_2$ of the printing unit group III. The task of the compensation elements 15, which constitute a dynamic actuator 16 and a gripper system 17, 18, is believed to be readily apparent in the sections I-IV of the transfer shown in FIG. 2.

In section I, the actuator 16 compensates for the phase difference between the printing unit groups II and III. This is performed during the transfer from the gripper system 17 of the printing unit group II to the gripper system 18 of the printing unit group III. To this end, the actuator 16, and therefore the gripper system 18, is displaced a phase difference $A_1$. At a location 21, transfer of the printed sheet takes place.

In section II, the actuator 16 performs a positional correction $A_2$ between the printing unit group II and the printing unit group III, after the printed sheet remains fixed only by the gripper system 18 of the first transfer cylinder 13 of the accepting printing unit group III. In this regard, the positional difference $A_1$ has to be taken into account, it having been induced by the torque fluctuations produced in section I by the gripper system 17, 18 and the actuator 16, respectively.

In section III, the actuator 16 is held in a rest position. At a location 22, the printed sheet is accepted with correct phase by a second cylinder 19 of the printing unit group III. In the illustration, the second cylinder 19 is represented as the first impression cylinder of the printing unit group III.

In section IV of FIG. 2, the actuator 16, and therefore the gripper system 18 of the first transfer cylinder 13 of the printing unit group III, is moved back over a displacement $A_3$ into the initial position thereof, so that, during the next transfer operation, the speed correction can be made with the greatest possible displacement. It is therefore necessary for the condition for the displacement of the actuator 16 to be satisfied:

$$A_1+A_2+A_3=0$$

Figure 3:
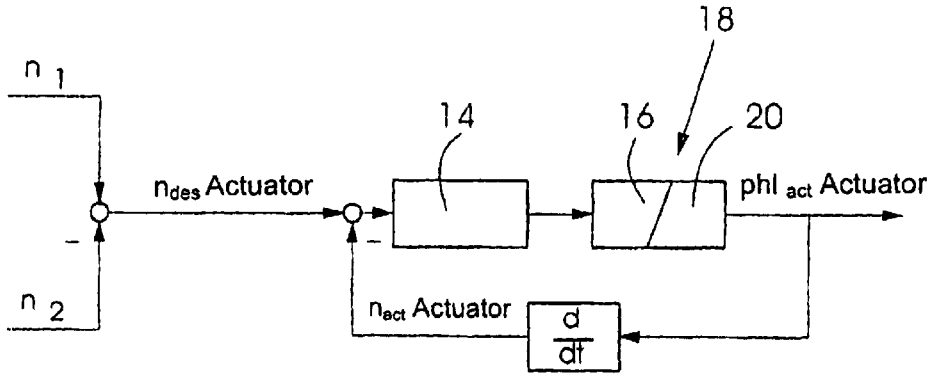
FIG. 3 is a block diagram for controlling the speed difference.

FIG. 3 is a block diagram for controlling the speed difference performed during the transfer of the printed sheet from the printing unit group II to the printing unit group III. First, the rotational speeds $n_1$ and $n_2$ are determined and passed on to the control device 14 as desired or nominal values. The control device 14 may be constructed as a PI controller and determines the displacement $A_1$ of the actuator 16 for the compensation of the speed difference between the two printing unit groups II and III. The control device 14 controls the gripper system 18, which constitutes the actuator 16 and a gripper bar 20 with the printed sheet. The actual position of the actuator 16 serves as a correction value $n_{act}$ for taking into account the respective displacement of the actuator 16.

Figure 4:
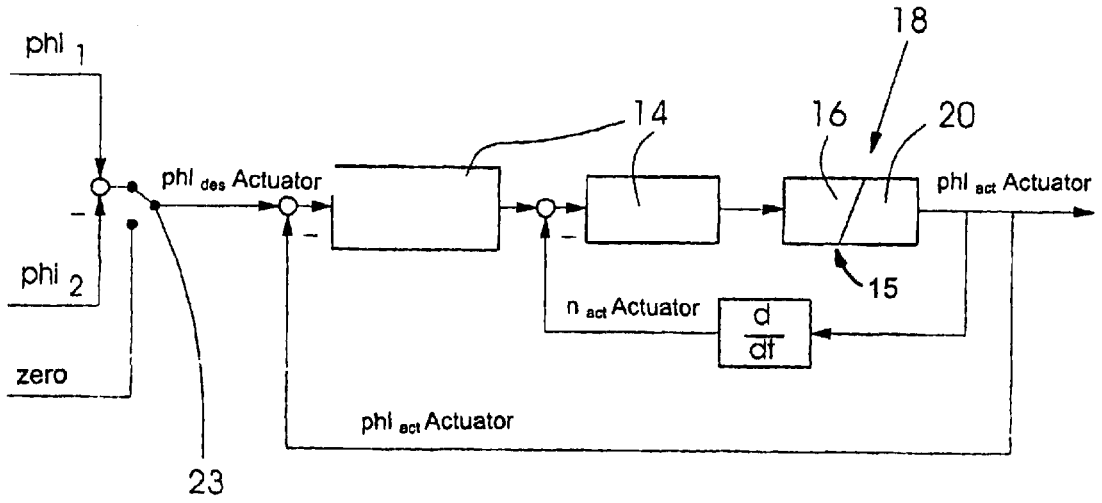
FIG. 4 is a block diagram for controlling the positional correction.

FIG. 4 is a block diagram for controlling the positional correction. Through the intermediary of the switch 23, the positional values of the printed sheet $phi_1$ and $phi_2$ are made available to the control device 14, which uses them to determine the desired or nominal value $phi_{dse}$ of the positional displacement $A_2$. Then, the displacement $A_1$ of the actuator 16 and of the gripper system 18 which has been performed by the displacement compensation is taken into account, as described in relation to FIG. 3. By a correction value $phi_{act}$, the position of the actuator 16 is taken into account during the positional correction. Via the switch 23, the actuator 16 is set to zero again following the transfer of the printed sheet to the gripper system of the second cylinder 19 (note FIG. 6), and is moved back over the displacement $A_3$ into the initial position.

Figure 5:
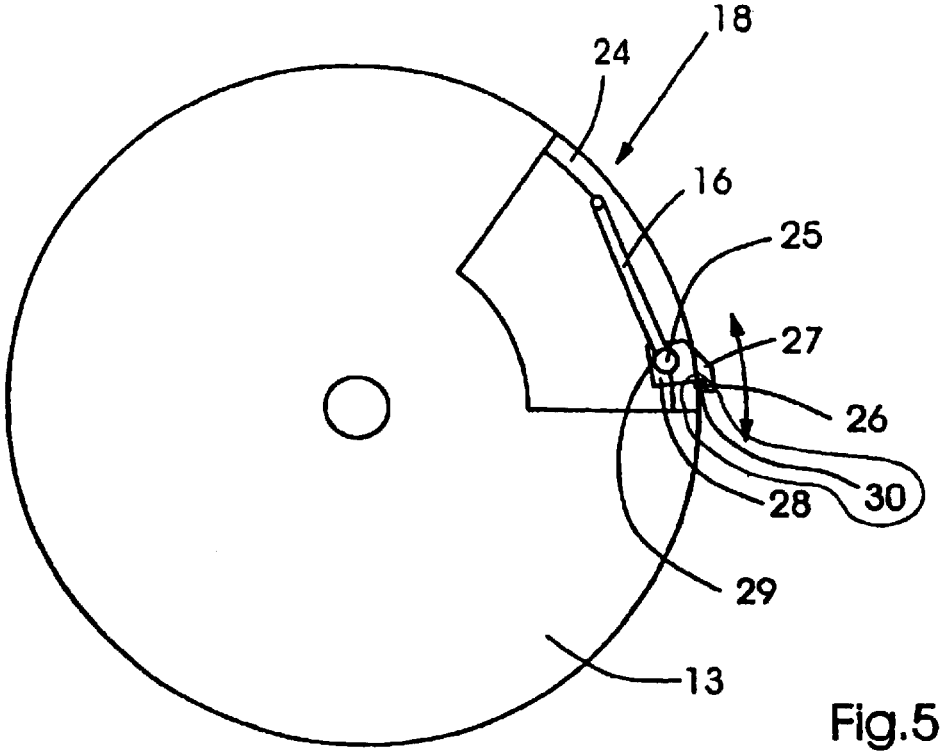
FIG. 5 is a diagrammatic end view of a transfer cylinder showing a gripper system thereon.

FIG. 5 shows a gripper system 18 on a transfer cylinder 13. Here, the gripper system 18, arranged in a cylinder gap or channel 24 extending axially in a sheet-carrying transfer cylinder 13 of the printing machine 1, is arranged on a slide 25 which has an angular cross section. At the upper end of an upwardly directed slide leg, there is disposed a gripper pad 26 for a gripper 27 of the gripper system 18 arranged on the slide 25. The horizontally extending leg 28 of the slide 25 is arranged by rolling-contact bearings on a non-illustrated bearing plate which can, in turn, move on rolling-contact bearings in the axial direction of the transfer cylinder 13. At both axial ends of the transfer cylinder 13, actuators are connected to the slide 25 and are activatable counter to the action of a spring which is braced by one end against the horizontal leg 28 of the slide 25 and by the other end against the wall of the cylinder gap or channel 24 formed in the transfer cylinder 13. The actuators are movable perpendicularly to the plane of the drawing, counter to the action of a spring. Arranged on the surface of the gripper pad 26 are electronic measuring elements 30, for example linear CCDs which can be illuminated, for registering the leading edge of the printed sheet, and the measuring elements supply, via a computer, control pulses for the actuators for the positional correction of the printed sheet in the conveying direction. For lateral sheet alignment, electronic measuring elements 30, for example likewise linear CCDs which can be illuminated, are arranged at least at one axial end of the transfer cylinder 13. The latter linear CCDs can be set in a conventional manner, as a function of the format, and, via one of the data processors of the control device 14, as shown in FIG. 1, control the actuators for the displacement of the gripper system 18 on the carriage in the direction of the cylinder axis. By using a desired or nominal/actual comparison, the measured values from the electronic measuring elements 30 on the gripper pad 26 are used by the control device 14 to obtain control pulses for the actuators for the positional correction in the conveying direction of the printed sheet and, by the electronic measuring elements 30 at the axial cylinder end, to obtain control signals for the lateral positional correction of the printed sheet. During these correctional movements, the printed sheet is held securely in the gripper system 18, so that the in-register transfer of the printed sheet to the gripper system of the subsequent second cylinder 19 of the printing unit group III is assured. Only after the printed sheet has been released by the gripper system 18 does the slide with the gripper system 18 arranged thereon return to the zero position as a result of the spring action.

Figure 6:
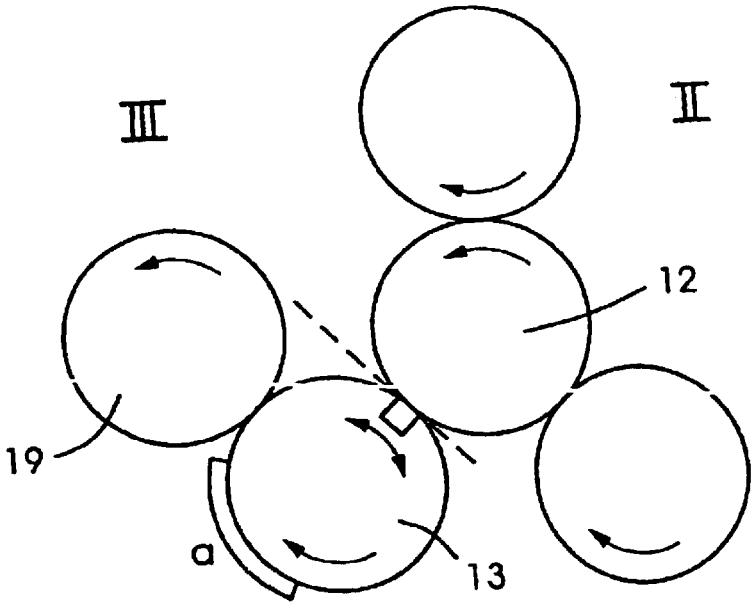
FIG. 6 is an enlarged fragmentary view of FIG. 1 showing a different embodiment of an arrangement of cylinders in a transfer region thereof.

FIG. 6 is a diagrammatic view of cylinders during the transfer of a printed sheet. In this regard, the cylinders are arranged between two printing unit groups II and III so that the transfer-error compensation can be performed according to the invention. The printing unit groups II and III are decoupled. The decoupling is represented by the straight broken line. The printed sheet is transferred by the gripper system 17 of the last sheet-carrying cylinder of the printing unit group II, which is represented as the impression cylinder 12, to the gripper system 18 of the transfer cylinder 13 of the printing unit group III. The printed sheet is then passed onward from the first transfer cylinder 13 of the printing unit group III to the second cylinder 19, which is represented as the first impression cylinder of the printing unit group III. Before being transferred to the gripper system of the second cylinder 19 of the accepting printing unit group III, the printed sheet is fixed at only one location. In this position, the positional compensation of the printed sheet can therefore be performed most desirably.

We claim:

1. A method of transferring printed sheets in a printing machine, which comprises determining a difference in speed between two decoupled printing unit groups, and displacing a gripper system parallel to the surface of a cylinder during the sheet transfer so as to compensate thereby for the difference in speed between the printing unit groups on a first transfer cylinder of an accepting printing unit group.

2. The method according to claim 1, which includes determining a positional error of the printed sheet on the first transfer cylinder of the accepting printing unit group, and correcting the position of the printed sheet parallel to the cylinder surface and axially displaceably on the first transfer cylinder of the accepting printing unit group.

3. The method according to claim 1, which includes having the dynamic control device register the operating parameters of the printing unit groups before the printed sheet is transferred, determine differences in speed and control the compensation elements in a compensatory manner during the sheet transfer.

4. The method according to claim 1, which includes having the dynamic control device register the position of the printed sheet on the first transfer cylinder of the accepting printing unit group after the sheet transfer, and control the compensation elements in a corrective manner after the sheet transfer.

5. The method according to claim 1, which includes completing the positional correction before the sheet transfer to the second cylinder of the accepting printing unit group.

6. The method according to claim 1, which includes, in a first step, wherein a difference in speed is compensated for, displacing the actuator parallel to the cylinder surface of the first transfer cylinder of the accepting printing unit group; in a second step, having the gripper system of the first transfer cylinder of the accepting printing unit group accept the printed sheet from the preceding printing unit group; in a third step, registering the position of the printed sheet and, if necessary, determining a positional correction; in a fourth step, having the actuator make the positional correction on the first transfer cylinder of the accepting printing unit group; in a fifth step, having the actuator moved into a rest position for the printed sheet transfer to the second cylinder of the accepting printing unit group; and in a sixth step, moving the actuator back into the initial position thereof after the printed sheet transfer to the second cylinder of the accepting printing unit group.

7. A printing machine for printing sheet material, the printing machine comprising:

at least two printing unit groups having drives decoupled from one another and assigned, respectively, to one printing unit group, and having printing units with transfer cylinders;

a dynamic control device for transferring printed sheets; and compensation elements for compensating for a speed difference and a positional error between two printing unit groups, said compensation elements being assigned to a first transfer cylinder of a printing unit group being an accepting printing unit group, in order to compensate for transfer errors, said compensation elements being capable of actively moving a sheet with respect to a surface of said first transfer cylinder;

said compensation elements having a gripper system, said gripper system including a dynamic actuator and a gripper bar for picking up the printed sheets, the position of said gripper bar being displaced by said actuator at constant radius in a peripheral direction on said surface of said first transfer cylinder in accordance with the speed difference.

8. The printing machine according to claim 7, wherein said gripper system is arranged parallel to said surface of said first transfer cylinder and axially displaceably on said first transfer cylinder.

9. The printing machine according to claim 8, wherein said transfer cylinders of said printing unit groups have an arrangement by which, after a printed sheet has been accepted by said gripper system of said first transfer cylinders the printed sheet is fixed only at one location in said accepting printing unit group.

10. The printing machine according to claim 7, wherein said actuator is an element selected from the group consisting of piezoelectric and magnetostrictive elements.

11. The printing machine according to claim 7, wherein said gripper bar is axially displaceable in the direction of the axis of rotation of said first transfer cylinder for correcting the position of the printed sheets.

* * * * *